US006899048B1

(12) United States Patent
Lo

(10) Patent No.: US 6,899,048 B1
(45) Date of Patent: May 31, 2005

(54) HIDDEN CABLE FIXED DEVICE

(75) Inventor: Nico Lo, Hsinchu (TW)

(73) Assignee: Hsiang Tzer Enterprise Co., Ltd., Hsinchu (TW)

( * ) Notice: Subject to any disclaimer, the term of this patent is extended or adjusted under 35 U.S.C. 154(b) by 27 days.

(21) Appl. No.: 10/772,462

(22) Filed: Feb. 6, 2004

(51) Int. Cl.[7] ..... B63B 21/04
(52) U.S. Cl. ..... 114/218
(58) Field of Search ..... 114/218; 410/107, 410/101, 111; 24/115 R, 115 G

(56) References Cited

U.S. PATENT DOCUMENTS 4,890,566 A * 1/1990 Morris ..... 114/218
4,945,849 A * 8/1990 Morris et al. ..... 114/218
5,004,388 A * 4/1991 Harris ..... 410/107
5,106,248 A * 4/1992 Harris ..... 410/107
6,651,576 B1 * 11/2003 Lo ..... 114/218

* cited by examiner

*Primary Examiner*—Ed Swinehart
(74) *Attorney, Agent, or Firm*—Rosenberg, Klein & Lee

(57) ABSTRACT

A hidden cable fixed device comprises a seat body, a movable handle provided in the seat body and sliding upward and downward with two springs, and a coupling member lodged in the inner wall of the seat body and coupled to a longitudinal track at the side wall of the movable handle. The longitudinal track has two substantially V-shaped parts as a positioning section and a guiding section. The coupling member is adapted to guide movement of the track of the movable handle and to selectively lock the movable handle between the extended operative position and the received non-operative position.

3 Claims, 10 Drawing Sheets

HIDDEN CABLE FIXED DEVICE

BACKGROUND OF THE INVENTION

1. Field of the Invention

The present invention relates to a cable fixed device, and more particularly relates to structural improvement of a cable fixed device that is movable and can conveniently be hidden.

2. Description of the Related Art

Cable fixed devices are usually distributed at the periphery in a boat and are fixed on a deck of a boat body. They are used to fix cargo on the boat or are used to tie cables when the boat is berthed at a dock.

As shown in FIG. 1, a conventional cleat structure for boat comprises a transverse rod 10 and two vertical rods 12 connected below the transverse rod 10. The transverse rod 10 is fixedly locked onto a boat deck 16 with two screw bolts 14 through the two vertical rods 12, and is provided for a cable tying. However, because existent cleats for boat are projective from and fixed on the boat deck 16, they not only occupy the space of the boat deck 16, but also may easily stumble careless people passing by to cause hazards.

In order to improve the above problems, another conventional cable fixed device was provided as shown in FIG. 2, which comprises a seat body 18 and a movable handle 20. The seat body 18 has a receiving cavity 22 for setting driving components (not shown) inside so that the movable handle 20 could slide upward and downward upon the seat body 18 by the driving components to show a state of hiding in or projecting from the seat body 18. While mounting, the boat deck is dug a large area and two holes for burying the seat body 18 in the boat deck and fixing the seat body 18 with two bolts 14 screwing through the holes. The cable fixed device has the advantage of capable of hiding, but relatively has large volume and heavy weight because of setting of the receiving cavity. Besides, while assembling the cable fixed device into the boat deck, it is necessary to dig the boat deck a large area and two holes. There are still some drawbacks with the structure of the cable fixed device.

Accordingly, the present invention aims to propose structural improvement of a hidden cable fixed device to provide a better cable fixed device.

SUMMARY OF THE INVENTION

The main object of the present invention is to provide a cable fixed device, which can be conveniently unfolded when in use and can be conveniently hidden when not in use, hence having the advantage of not occupying space and convenient use.

Another object of the present invention is to provide a hidden cable fixed device for boat, which can effectively prevent people passing by from stumbling to provide a high-safety cable fixed device.

Another object of the present invention is to provide a hidden cable fixed device, which has the advantages of small volume and convenient for transportation.

Still another object of the present invention is to provide a hidden cable fixed device, which can be easily and conveniently mounted onto a boat deck.

To achieve the above objects, the hidden cable fixed device comprises a seat body with a receiving space inside, a movable handle, two elastic components, and a coupling member. The movable handle longitudinally connects onto the seat body, and can slide up and down upon the seat body. The elastic components are disposed in the sliding direction between the movable handle and the seat body. The sidewall of the movable handle has a longitudinal track that has two substantially V-shaped parts as a positioning section and a guiding section. One side of the coupling member is fixed to the seat body and can rotate at its origin position, and the other side is coupled to the track on the movable handle. So as to let the longitudinal track move relative to the coupling member and lead it rotating, and the coupling member could guide movement of the longitudinal track of the movable handle and to selectively lock the movable handle between the extended operative position and the received non-operative position.

DETAILED DESCRIPTION OF THE PREFERRED EMBODIMENT

Figure 1:
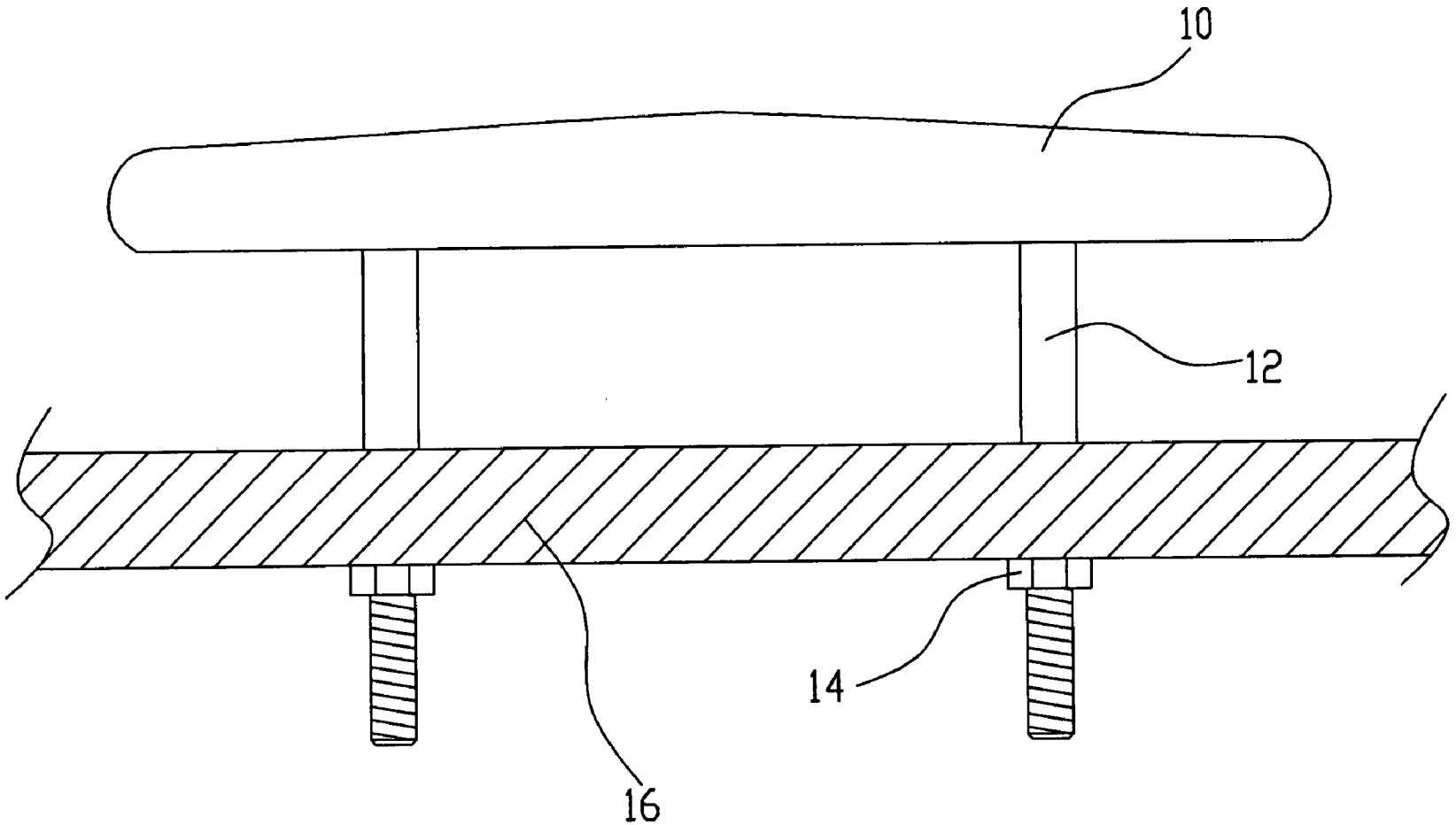
FIG. 1 (Prior Art)
FIG. 1 is a structure diagram of a conventional cable fixed device.
Figure 2:
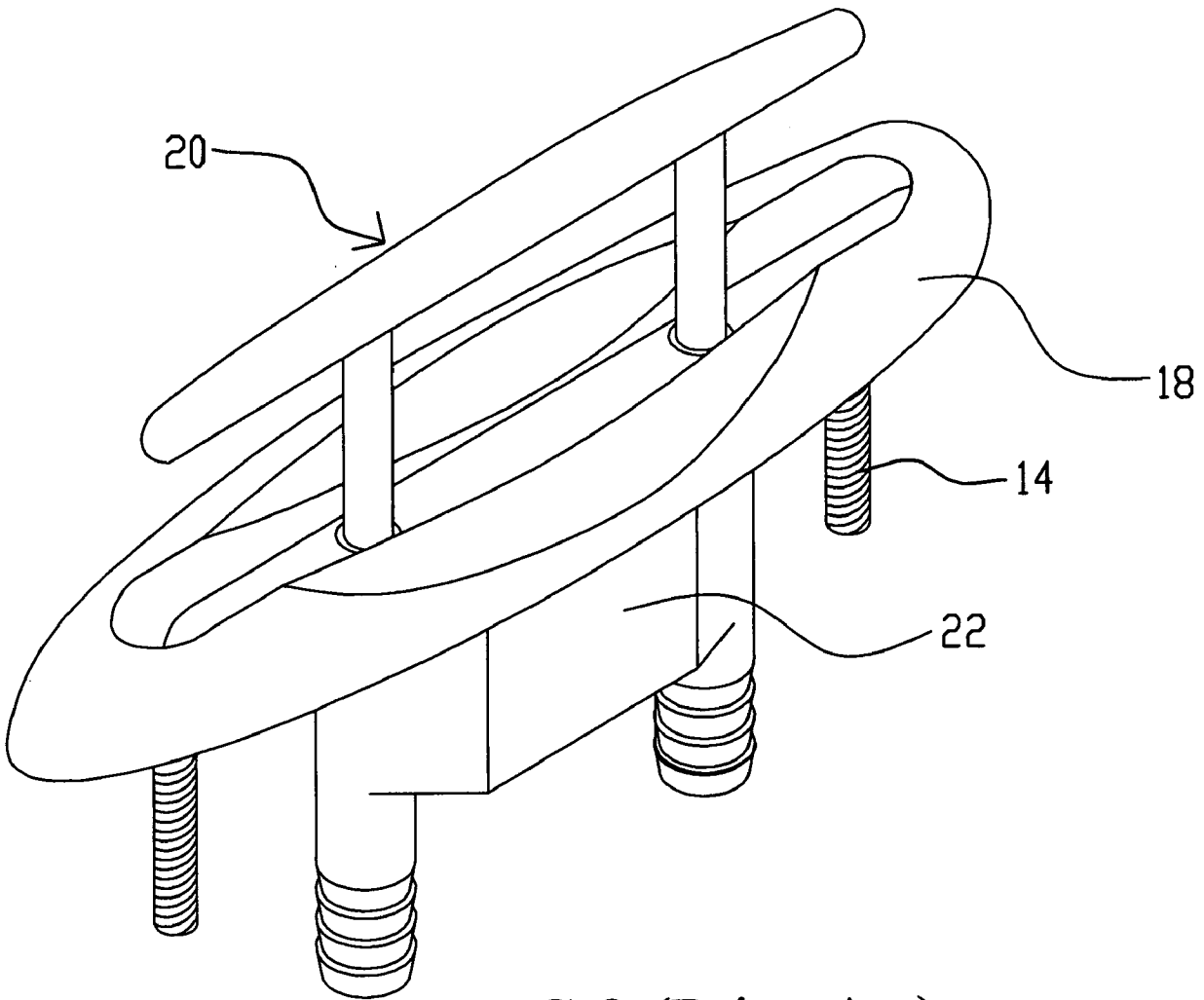
FIG.2 (Prior Art)
FIG. 2 is a structure diagram of a conventional hidden cable fixed device.
Figure 3:
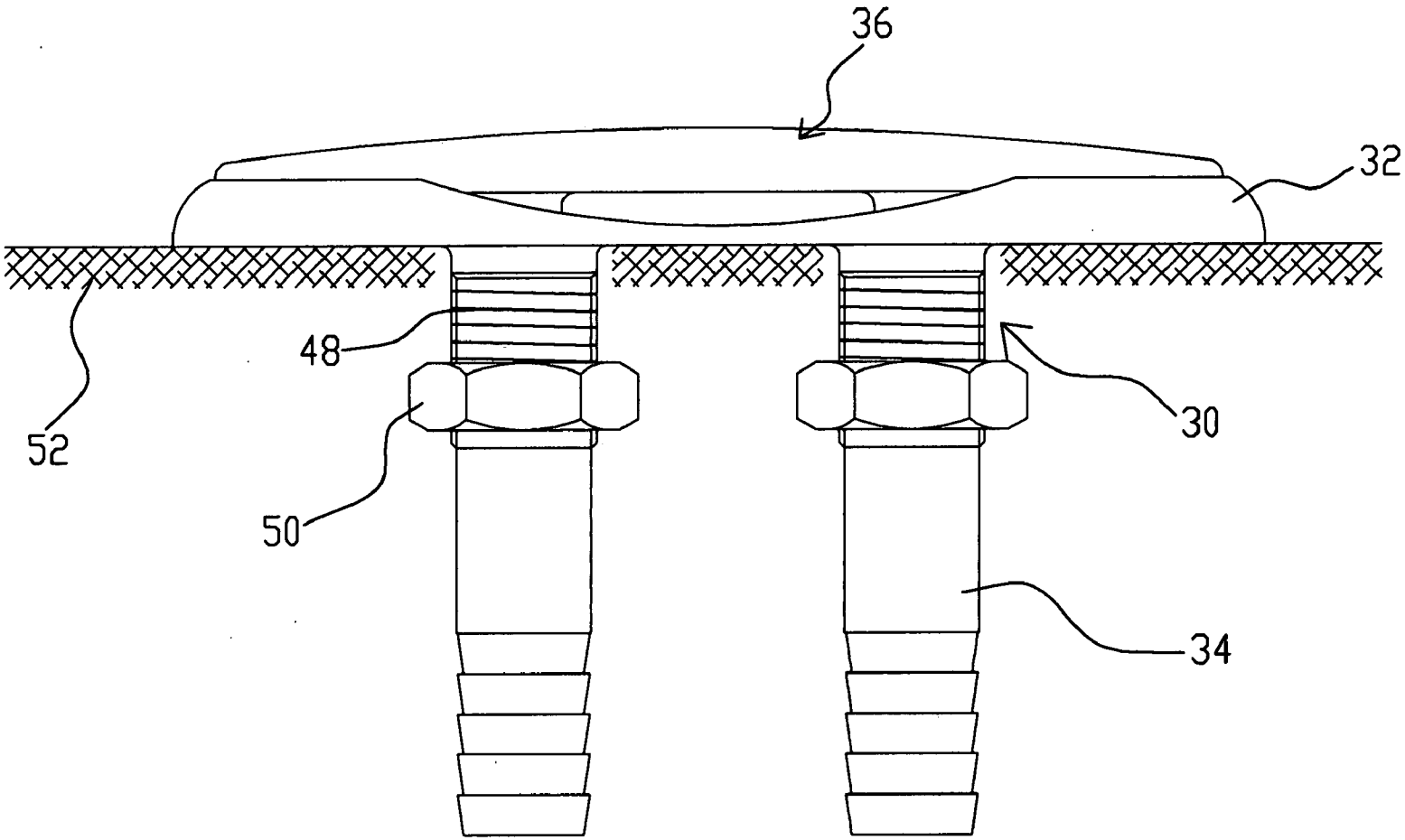
FIG. 3 is a diagram of a cable fixed device according to the present invention.
Figure 4:
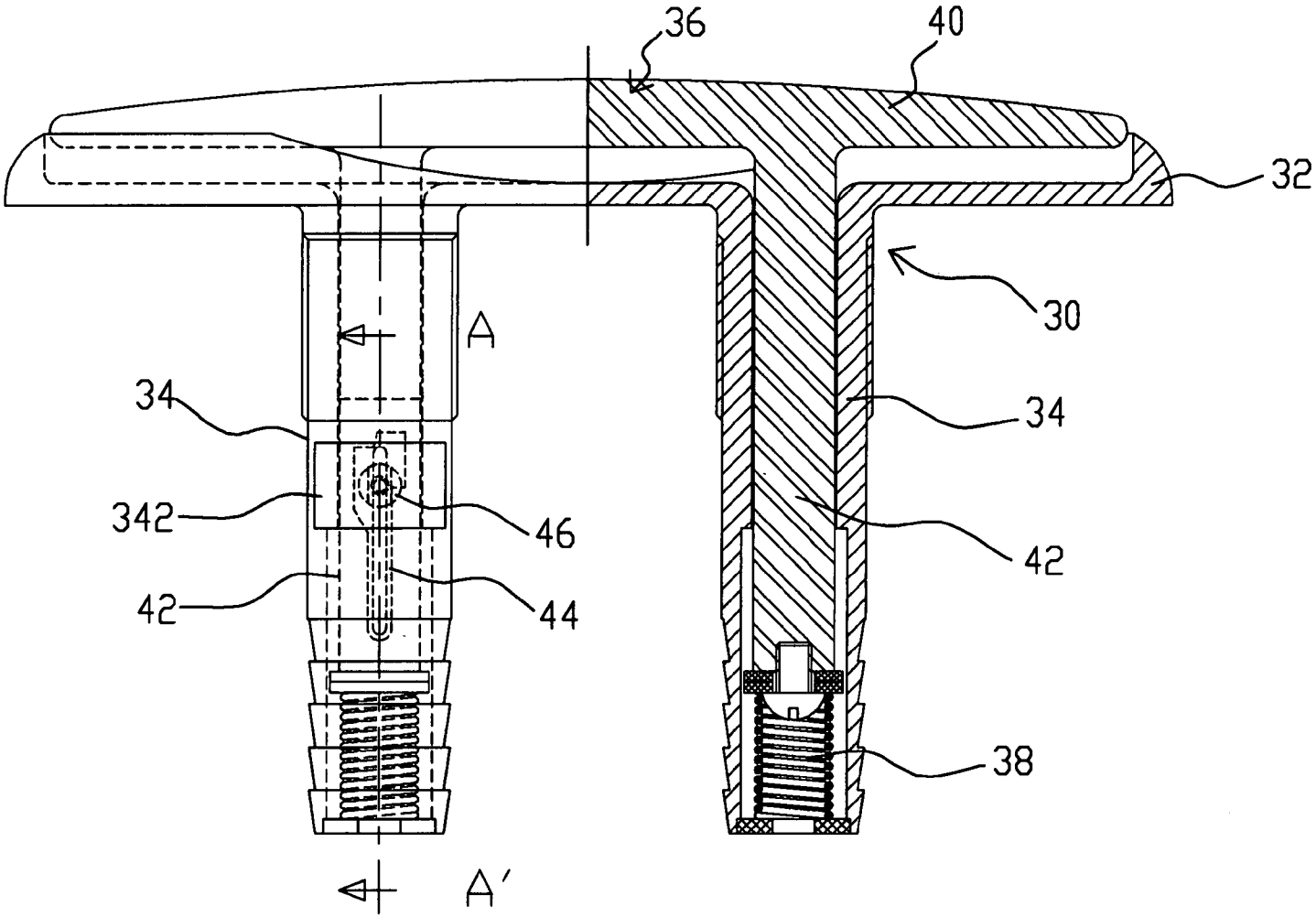
FIG. 4 is a sectional view of the cable fixed device according to the present invention.

As shown in FIGS. 3 and 4, a cable fixed device comprises a seat body 30 having a transverse fillister 32 and two under connected tube 34 so as to construct a receiving space in the seat body 30 for receiving a movable handle 36. The movable handle 36 longitudinally connects with the seat body 30, and can slide up and down upon the seat body 30. Two elastic components, usually being springs 38, are disposed in the sliding direction between the movable handle 36 and the seat body 30. The movable handle 36 comprises a transverse rod 40 and two vertical rods 42 connected below the transverse rod 40. The movable handle 36 uses the two vertical rods 42 to connect the springs 38 so as to be disposed in the tubes 34 of the seat body 30. A slidable connection is thus formed between the movable handle 36 and the seat body 30. The transverse fillister 32 is disposed at the top of the seat body 30 corresponding to the position exactly below the transverse rod 40 of the movable handle 36 so as to receive and hide the transverse rod 40.

Figure 5:
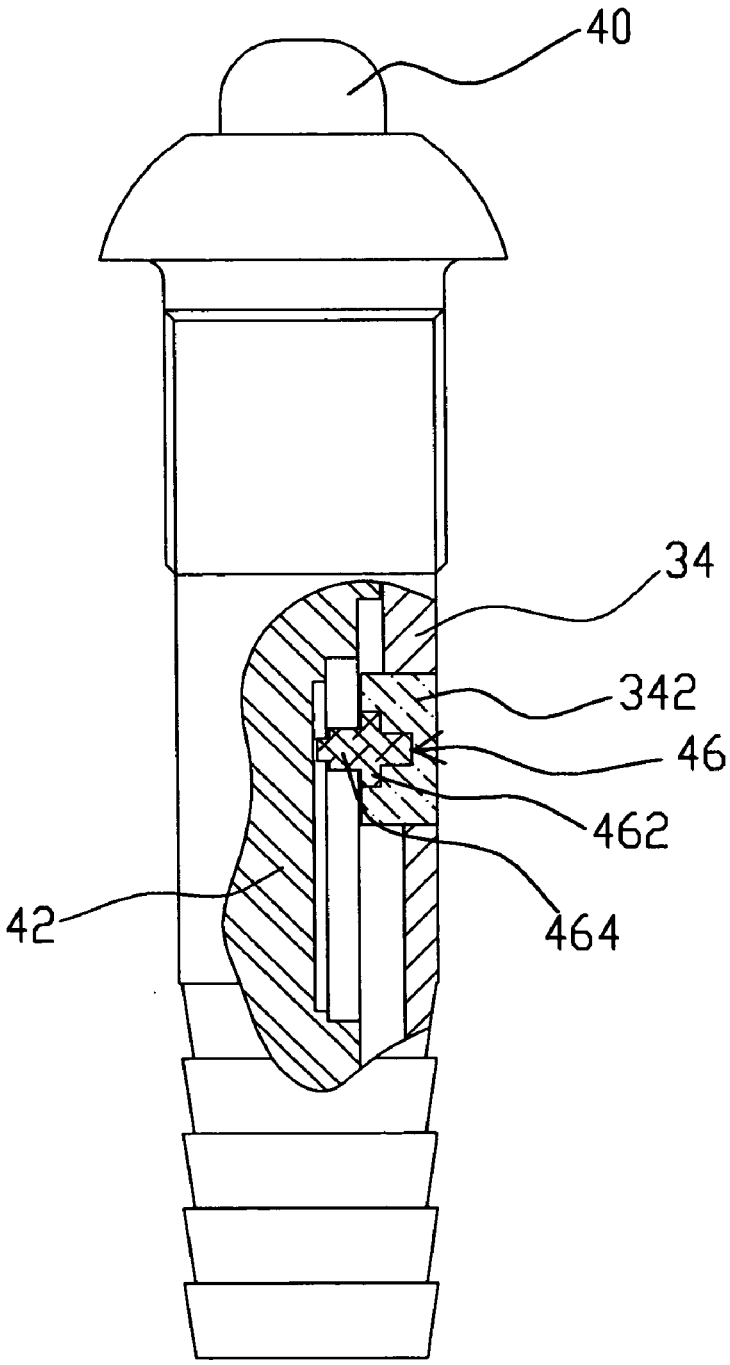
FIG. 5 is a sectional view from line AA' of FIG. 4.
Figure 6:
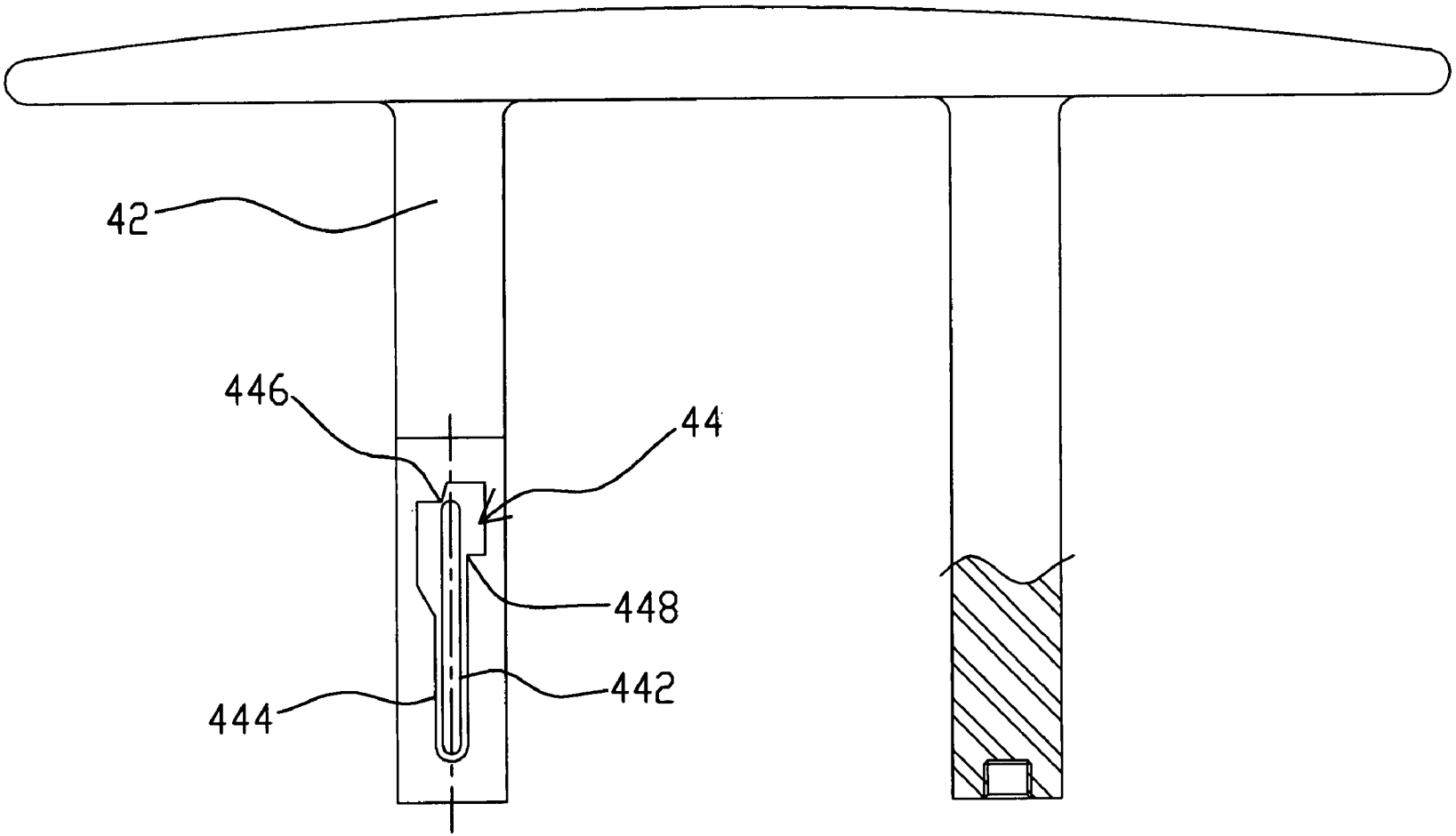
FIG. 6 is a sectional view of the movable handle for the cable fixed device according to the present invention.

The surface of one of the vertical rods 42 is defined a longitudinal track 44. Referring to FIGS. 5 & 6, which are respectively a sectional view from line AA' of FIG. 4 and a sectional view of the movable handle. The track 44 comprises a longitudinally deep groove 442 in the center and a shadow groove around the center groove 442. The shadow groove is formed of an U-shaped section 444 corresponding to the half-lower part of the center groove 442, a substantially V-shaped guide section 446 extended from one end of the U-shaped section 444 corresponding to the left side of the upper part of the center groove 442, and a substantially V-shaped position section 448 extended from the other end of the U-shaped section 444 corresponding to the right side of the middle part of the center groove 442. So that the tips of the two V-shaped sections 446, 448 are toward the interior of the longitudinal track 44 and are disposed at eccentric position of the central line of the longitudinal track 44.

Figure 7:
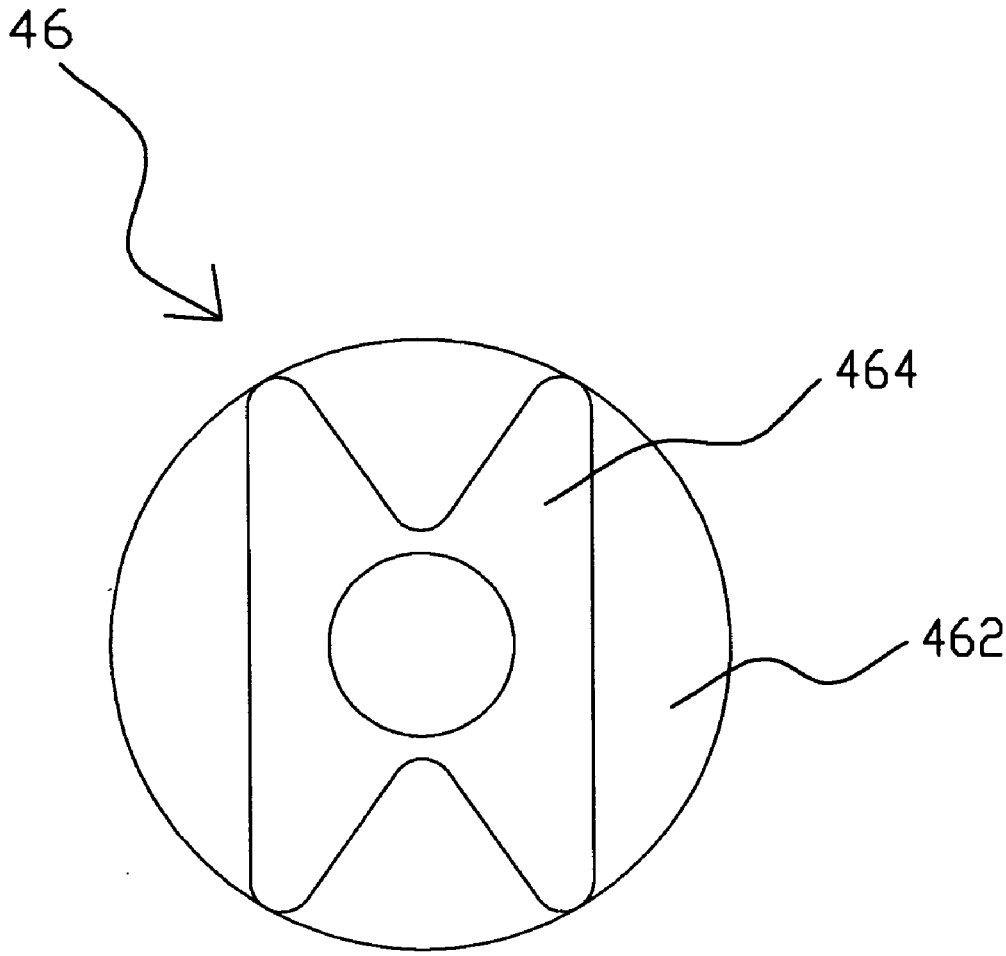
FIG. 7 is a plain view of the coupling block for the cable fixed device according to the present invention.

Referring to FIG. 7 simultaneously, a coupling member 46 is composed of a guide disk 462 and a butterfly control block 464 fixed with the guide disk 462. One side of the coupling member 46 and the guide disk 462 are lodged in the inner wall of the tube 34 for rotating in situ, and the other side of the coupling member 46 is coupled to the center groove 442 of the track 44 at the vertical rod 42 to make the butterfly control block 464 lie in the track 44 for guiding vertical movement of the movable handle 36. The butterfly control block 464 is fastened pivotally with the guide disk 462 and adapted to control movement and positioning of the track 44. The track 44 can be moved vertically relative to the coupling member 46 only when the two opposite long sides of the butterfly control block 464 maintained in parallel to the U-shaped section 444. So as when a user presses the movable handle 36 downwards from the extended operative position to the received non-operative position, the track 44 moves downwards relative to the coupling member 46 until the V-shaped position section 448 wedged with the butterfly control block 464, and the track 44 stops to hold the movable handle 36 in the received non-operative position. When the user presses the movable handle 36 again, the track 44 is disengaged from the butterfly control block 464 and moves further downwards to make the top of the track 44 and the guide section 446 guide the coupling member 46 rotating again to parallel with the U-shaped section 444. And meanwhile due to the upward pressure from the compression spring 38, the track 44 slides upwards to hold the movable handle 36 in the extended operative position.

In the above-mentioned structure, while manufacturing the coupling member 46 onto the inner wall of the tube 34, referring to FIGS. 4 & 5, the steps are as follows. First, cutting a combination piece 342 from the tube 34, and then excavating the combination piece 342 an appropriate a deep hole and a disk-shaped fillister for setting one end of the coupling member 46 and the guide disk 462, then followed by soldering the combination piece 342 back with the tube 34, polishing the soldering position. By which, mounting of the coupling member 46 is finished.

The track 44 and the coupling member 46 are usually sited respectively at just one vertical rod 42 of the movable handle 36 and its relative tube 34. If both the two vertical rods 42 and the two tubes 34 have the tracks 44 and the coupling members 46, the movement of two side of the movable handle 36 must be synchronous, or the movable handle 36 is easily jammed or hindered. Thus only one side of the movable handle 36 has the track 44 and the coupling member 46 set, and movement of the other side is driven by the spring 38 to complete the all action of the movable handle 36.

Further referring to FIG. 3, threads 48 are provided on the outer surface of the two tubes 34, and a screw nut 50 is coupled to the thread 48. When mounting the cable fixed device, it is just necessary to excavating two through holes on the boat deck 52, putting the tubes 34 through the holes, and screwing the nuts 50 upon the threads 48, then adjusting the height of the nuts 50 to firmly fix the seat body 30 on the boat deck 52. Hence the present invention has the advantage of convenient for mounting. It is only necessary to excavate two through holes instead of excavating a large area and two holes. Besides, there is no need to set a receiving cavity in the seat body as the prior art, thus the present invention also has the advantages of small volume and lightweight so as the finished products are convenient for transporting.

Figure 8:
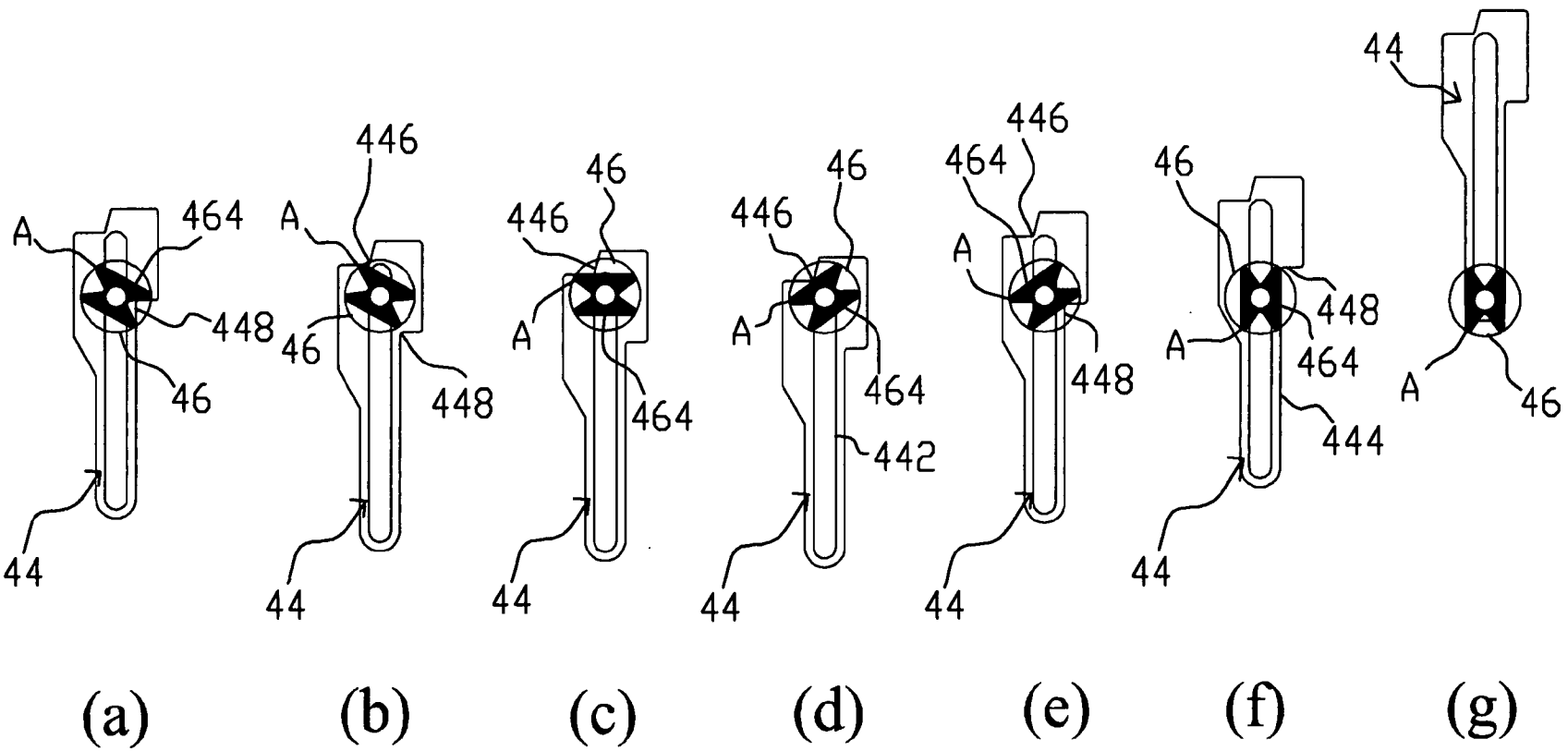
FIGS. 8(*a*)~8(*e*) are continuous drawings explaining the action of the track of the movable handle relative to the coupling block when the movable handle moved from the received non-operative position to the extended operative position.
Figure 9:
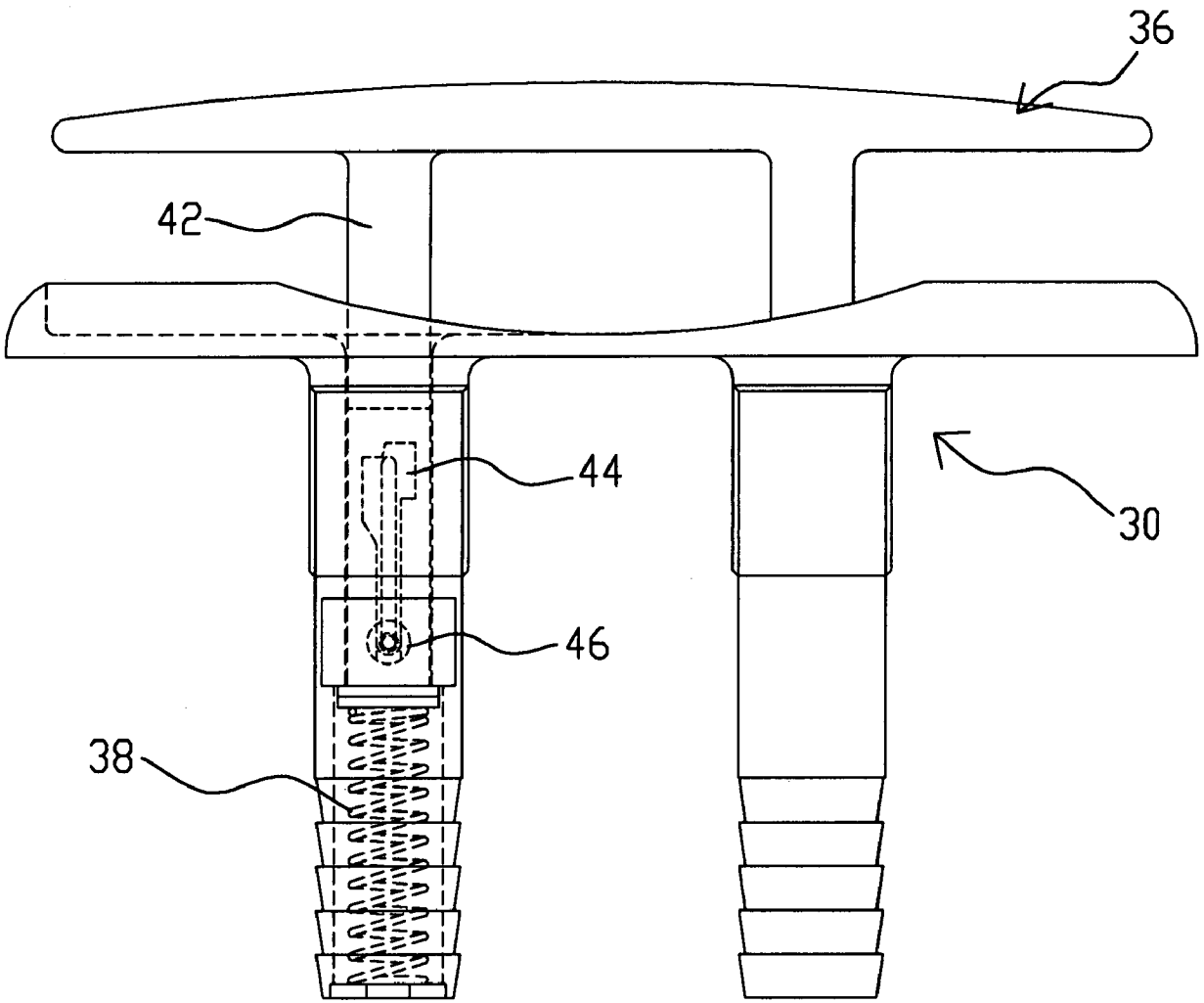
FIG. 9 is another sectional view of the present invention, showing the movable handle projecting from the seat body.

After describing the structure and work principle of the hidden cable fixed device according to the present invention, continuously the detail action will be described. As shown in FIGS. 4 and 5, the movable handle 36 of the cable fixed device is usually in the hidden state. And at this moment, the state of the track 44 is as shown in FIG. 8(*a*). The track 44 is stopped by its V-shaped position section 448 wedged with the butterfly control block 464 of the coupling block 46. When a cable is to be wound and tied up, it is only necessary to press the movable handle 36 downwards with the hand. After the movable handle 36 transfers the external force to the track 44, as shown in FIG. 8(*b*), the track 44 is forced to move downwards, thereby causing the V-shaped guide section 446 contacting with the point A of the butterfly control block 464. With downward action of the V-shaped guide section 446, the point A of the butterfly control block 464 is guided to rotate counter-clockwise, thereby causing the coupling member 46 to be rotated counter-clockwise synchronously. At this moment, the movable handle 36 is continuously affected by downward force so as to keep moving downwards, hence the coupling block 46 is sited at the top end of the center groove 442, as shown in FIGS. 8(*c*) & 8(*d*). When released the hand from the movable handle 36, at this time, the compression spring 38 forces the movable handle 36 vertically upwards as shown in FIG. 8(*e*), and the track 44 moves upwards relative to the coupling member 46. When the V-shaped position section 448 collide with the butterfly control block 464, under the eccentric effect of the V-shaped position section 448, the butterfly control block 464 is rotated counter-clockwise again so as to parallel to the U-shaped section 444, as shown in FIG. 8(*f*), so that the track 44 could move upwards continuously until the coupling member 46 sited at the bottom of the track 44 as shown in FIG. 8(*g*). At this time, the movable handle 36 is extended out from the seat body 30, as shown in FIG. 9. This is the unfolded state.

Figure 10:
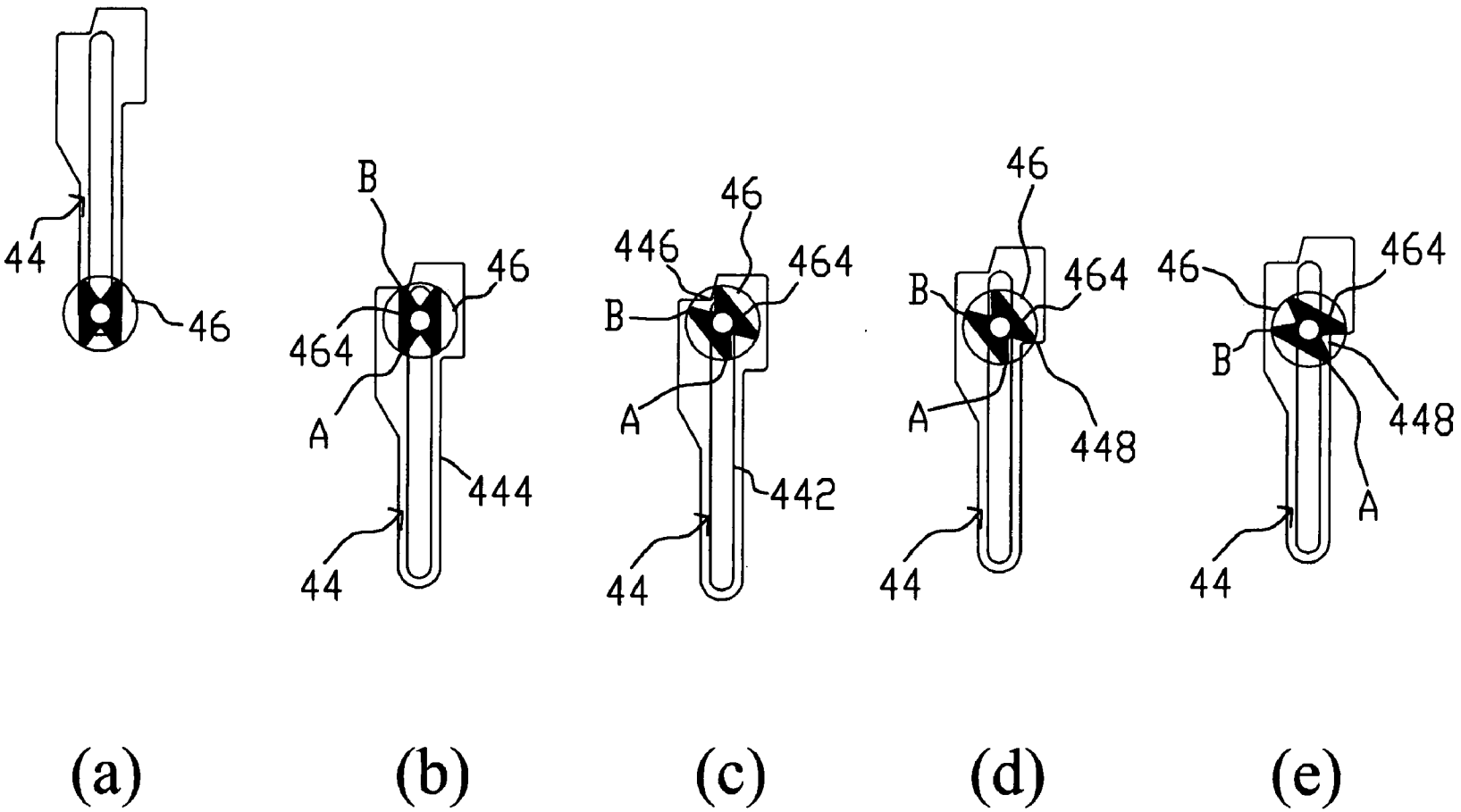
FIGS. 10(*a*)~10(*e*) are continuous drawings explaining the action of the track of the movable handle relative to the coupling block when the movable handle moved from the extended operative position to the received non-operative position.

When a user needs not to tie a cable, he applies a vertical downward external force to the movable handle 36 again. Similarly, during downward stroke of the movable handle 36, the track 44 is moved relative to the coupling member 46 from the upper limit position as shown in FIG. 10(*a*) toward the position shown in FIG. 10(*b*). When reached the position shown in FIG. 10(*b*), the point B of the butterfly control block 464 is forced against a part of the V-shaped guide section 446, thereby causing the butterfly control block 464 to rotate counter-clockwise as shown in FIG. 10(*c*). When released the hand from the movable handle 36 at this time, the compression spring 38 immediately forces the movable handle 36 upwards, thereby causing the track 44 to move upwards, too, until the V-shaped position section 448 contacting with the butterfly control block 464 to be stopped as shown in FIG. 10(*d*). At this moment, the butterfly control block 464 is rotating counter-clockwise again under the eccentric effect of the V-shaped position section 448 until the state shown in FIG. 10(*e*). That is the point A is against the V-shaped position section 448, and the V-shaped position section 448 is wedged with the butterfly control block 464, hence having no more relative motion. Therefore the movable handle 36 is hidden in the seat body 30. Thereby, the above reciprocating actions can be continually repeated.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A hidden cable fixed device comprising:

a seat body having a receiving space therein;

a movable handle longitudinally mounted in the seat body and capable of sliding up and down upon the seat body, a longitudinal track being disposed on the side wall of the movable handle, said track comprising a substantially V-shaped guiding section upwardly and a substantially V-shaped positioning section downwardly disposed respectively at two side of the track so that the tips of the two V-shaped sections are toward the interior of the longitudinal track and are disposed at eccentric position of the central line of the longitudinal track, said movable handle includes a transverse rod and two vertical rods connected below said transverse rod, said track being disposed on the surface of one of the vertical rods;

at least two elastic components disposed in the sliding direction between the movable handle and the seat body, said movable handle utilizing said two vertical rods to connect said elastic components so as to be disposed in said seat body in the sliding direction; and a coupling member with one side lodged in the inner wall of the seat body and the other side disposed in the longitudinal track of the movable handle so that making the track move relative to the coupling member and simultaneously guide the coupling member rotating to wedge the V-shaped positioning section by pressing the movable handle and making the track move continuously and guide the coupling member rotating for moving upward by pressing the movable handle again to further drive the movable handle do actions of going back and standing out of the seat body.

2. The hidden cable fixed device as claimed in claim 1, wherein the seat body comprises a transverse fillister and two tubes connected below said transverse fillister to let said elastic components be located respectively in said tubes and the coupling member be disposed at the inner wall of one of the tubes.

3. The hidden cable fixed device as claimed in claim 1, wherein the elastic components are springs.

* * * * *